US007147497B1

(12) United States Patent
Liao

(10) Patent No.: US 7,147,497 B1
(45) Date of Patent: Dec. 12, 2006

(54) AUDIO JACK CONNECTOR

(75) Inventor: Chun-Ying Liao, Taoyuan Hsien (TW)

(73) Assignee: Speed Tech Corp., Taoyuan (TW)

( * ) Notice: Subject to any disclaimer, the term of this patent is extended or adjusted under 35 U.S.C. 154(b) by 0 days.

(21) Appl. No.: 11/308,983

(22) Filed: Jun. 2, 2006

(51) Int. Cl.
*H01R 29/00* (2006.01)

(52) U.S. Cl. ..... 439/188; 200/51.1

(58) Field of Classification Search ..... 439/188, 439/668, 669, 944; 200/51.09, 51.1
See application file for complete search history.

(56) References Cited

U.S. PATENT DOCUMENTS 4,978,310 A * 12/1990 Shichida ..... 439/188
6,319,030 B1 * 11/2001 Wu ..... 439/188
6,382,999 B1 * 5/2002 Mou et al. ..... 439/188

* cited by examiner

*Primary Examiner*—Tho D. Ta
(74) *Attorney, Agent, or Firm*—Jianq Chyun IP Office

(57) ABSTRACT

An audio jack connector suitable for connecting to a plug is provided. The audio jack connector includes an insulating housing, a set of switch terminals, an insulating wrap and a plurality of signal terminals. The insulating housing includes an inserting hole and a chamber. The inserting hole is linked to the chamber. The set of switch terminals includes a first terminal and a second terminal disposed on the corresponding sidewall of the chamber. The second terminal has a contacting part and the insulating wrap covers a portion of the contacting part. The signal terminals are also disposed on the sidewall of the chamber. When the plug is inserted into the chamber, a portion of the contacting part uncovered by the insulating wrap is electrically connected to the first terminal while the portion of the contacting part covered by the insulating wrap is electrically insulated from the plug.

7 Claims, 3 Drawing Sheets

AUDIO JACK CONNECTOR

BACKGROUND OF THE INVENTION

1. Field of the Invention

The present invention relates to a connector, and more particularly, to an audio jack connector.

2. Description of Related Art

In the technologically advanced society, many types of electronic products have audio playback function. The most common electronic products with the audio playback function include, for example, MP3 portable music player, notebook (NB) computer or personal digital assistant (PDA). Yet, whatever the type of product, a user must be given a means of listening to audio messages (or signals) through an earphone or a speaker. Therefore, an audio jack connector has to be installed on the electronic product so that the plug of an earphone or a speaker may be inserted for connecting with the electronic product. In this way, the user can access the audio message (or signal) provided by the electronic product.

With the continuous progress of technology, new audio specifications keep appearing in the market. At present, the newer "Azalia" sound effect specification has gradually replaced the older "AC97" sound effect specification. Following the change in mainstream sound effect specification, the specification of the audio jack connector disposed on the electronic product is also changed. Therefore, the capacity to provide an audio jack connector meeting the Azalia sound effect specification is an important agenda.

SUMMARY OF THE INVENTION

Accordingly, at least one objective of the present invention is to provide an improved audio jack connector capable of meeting Azalia sound effect specification.

To achieve this and other advantages and in accordance with the purpose of the invention, as embodied and broadly described herein, the invention provides an audio jack connector suitable for connecting with a plug. The audio jack connector includes an insulating housing, a set of switch terminals, an insulating wrap and a plurality of signal terminals. The insulating housing includes an inserting hole and a chamber. The inserting hole is linked to the chamber. The plug is suitable for pushing through the inserting hole along a moving path and lodging the plug within the chamber. The set of switch terminals includes a first terminal and a second terminal disposed on the corresponding sidewall of the chamber. The second terminal has a contacting part disposed on the moving path of the plug and the insulating wrap covers a portion of the contacting part. The signal terminals are also disposed on the sidewall of the chamber. When the plug is inserted into the chamber, the signal terminals are in contact with the plug. Furthermore, the plug also pushes the contacting part so that a portion of the contacting part uncovered by the insulating wrap is electrically connected to the first terminal while the portion of the contacting part covered by the insulating wrap is electrically insulated from the plug.

In one embodiment of the present invention, the foregoing insulating housing further includes a plurality of insertion slots disposed on the side edge of the chamber and linked to the chamber. The set of switch terminals and the signal terminals are disposed within their corresponding insertion slots.

In one embodiment of the present invention, the foregoing insulating housing further includes at least a positioning pin disposed on a bottom surface of the insulating housing.

In one embodiment of the present invention, the foregoing first terminal includes a first terminal body and a first elastic contact arm. The first elastic contact arm extends from the first terminal body and has a first contact spot, for example. The first contact spot is suitable for electrically connecting with the portion of the contacting part not covered by the insulating wrap.

In one embodiment of the present invention, the foregoing second terminal includes a second terminal body and a second elastic contact arm. The second elastic contact arm extends from the second terminal body to the moving path and the contacting part is located at one end of the second elastic contact arm that extends to the moving path, for example.

In one embodiment of the present invention, each one of the signal terminals includes a signal terminal body and a third elastic contact arm. The third elastic contact arm extends from the signal terminal body and has a second contact spot suitable for electrically connecting with the plug, for example.

In one embodiment of the present invention, the audio jack connector may further include a rear cover disposed at another end corresponding to the plug opening of the insulating housing.

In the present invention, the insulating wrap covers a portion of the contacting part. Thus, when the plug is inserted into the chamber, the portion of the contacting part not covered by the insulating wrap is electrically connected to the first terminal and the portion of the contacting part covered by the insulating wrap is electrically insulated from the plug. Therefore, the audio jack connector is able to match the Azalia sound effect specification.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
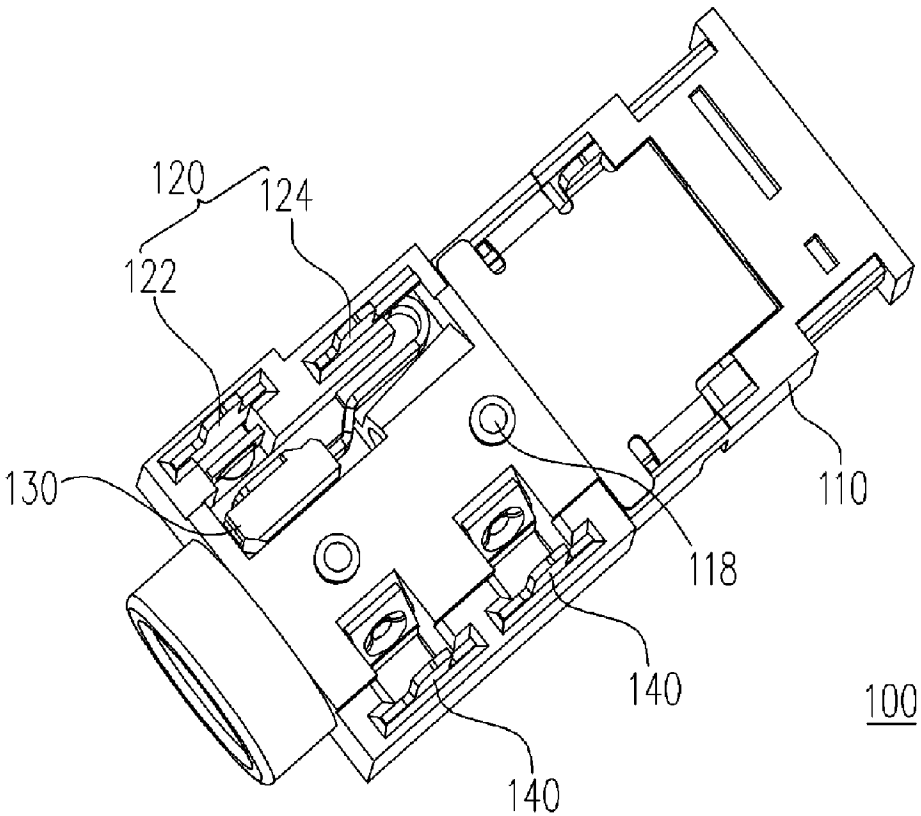
FIG. 1 is a perspective view of an audio jack connector assembly according to one preferred embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
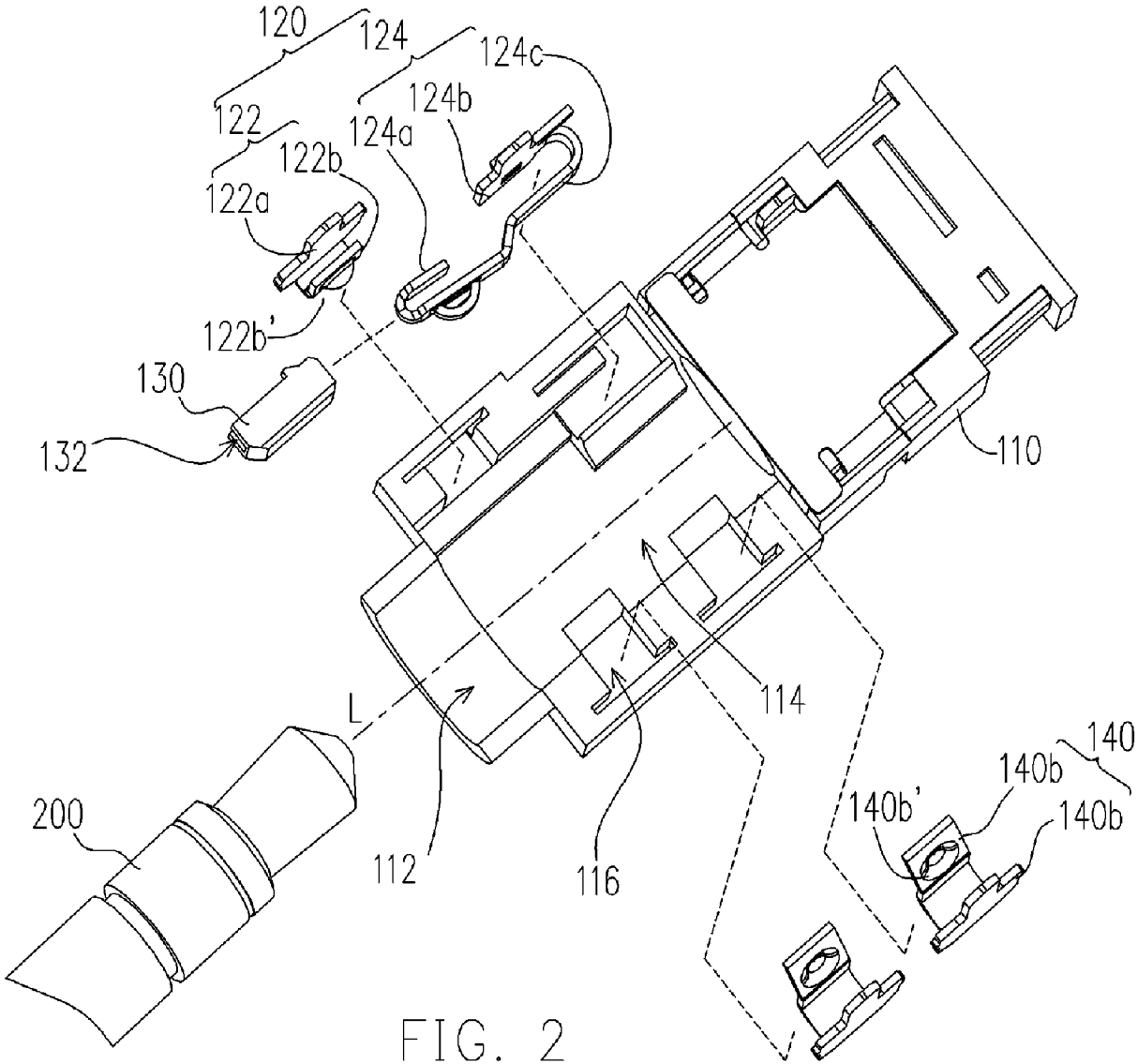
FIG. 2 is a perspective view showing a partially dissociated audio jack connector after part of the insulating housing is removed according to one preferred embodiment of the present invention.

The audio jack connector in the present invention is suitable for disposing inside an electronic product such as an MP3 portable music player, a notebook (NB) computer or a personal digital assistant (PDA). A user may plug the audio plug of an earphone or a speaker into the audio jack connector to listen to the audio message (or signal) provided by the electronic product. FIG. 1 is a perspective view of an audio jack connector assembly according to one preferred embodiment of the present invention. FIG. 2 is a perspective view showing a partially dissociated audio jack connector after part of the insulating housing is removed according to one preferred embodiment of the present invention. As shown in FIGS. 1 and 2, the audio jack connector 100 in the present embodiment is suitable for connecting with a plug 200. The audio jack connector 100 comprises an insulating housing 110, a set of switch terminals 120, an insulating wrap 130 and a plurality of signal terminals 140 (two are shown in FIG. 1). The insulating housing 110 has an inserting hole 112 and a chamber 114. The inserting hole 112 and the chamber 114 are linked together. The plug 200 is suitable for pushing through the inserting hole 112 along a moving path and lodging the plug 200 within the chamber 114. The switch terminals 120 have a first terminal 122 and a second terminal 124. The first terminal 122 and the second terminal 124 are disposed on the sidewall of the chamber 114. Similarly, the signal terminals 140 are disposed on corresponding locations on the sidewall of the chamber 114. In one preferred embodiment, a plurality of inserting slots 116 linked to the chamber 114 are disposed, for example, on the side edge of the chamber 114. The first terminal 122, the second terminal 124 and the signal terminals 140 are, for example, disposed in their corresponding inserting slots 116 respectively.

The second terminal 124 in the present embodiment has a contacting part 124*a* located on the moving path L and the insulating wrap 130 covers a portion of the contacting part 124*a*. In the present embodiment, the insulating wrap 130 has a slot 132 and the contacting part 124*a* of the second terminal 124 is, for example, embedded within the slot 132. Hence, the insulating wrap 130 facing one side of the first terminal 122 exposes a portion of the contacting part 124*a*.

Figure 3:
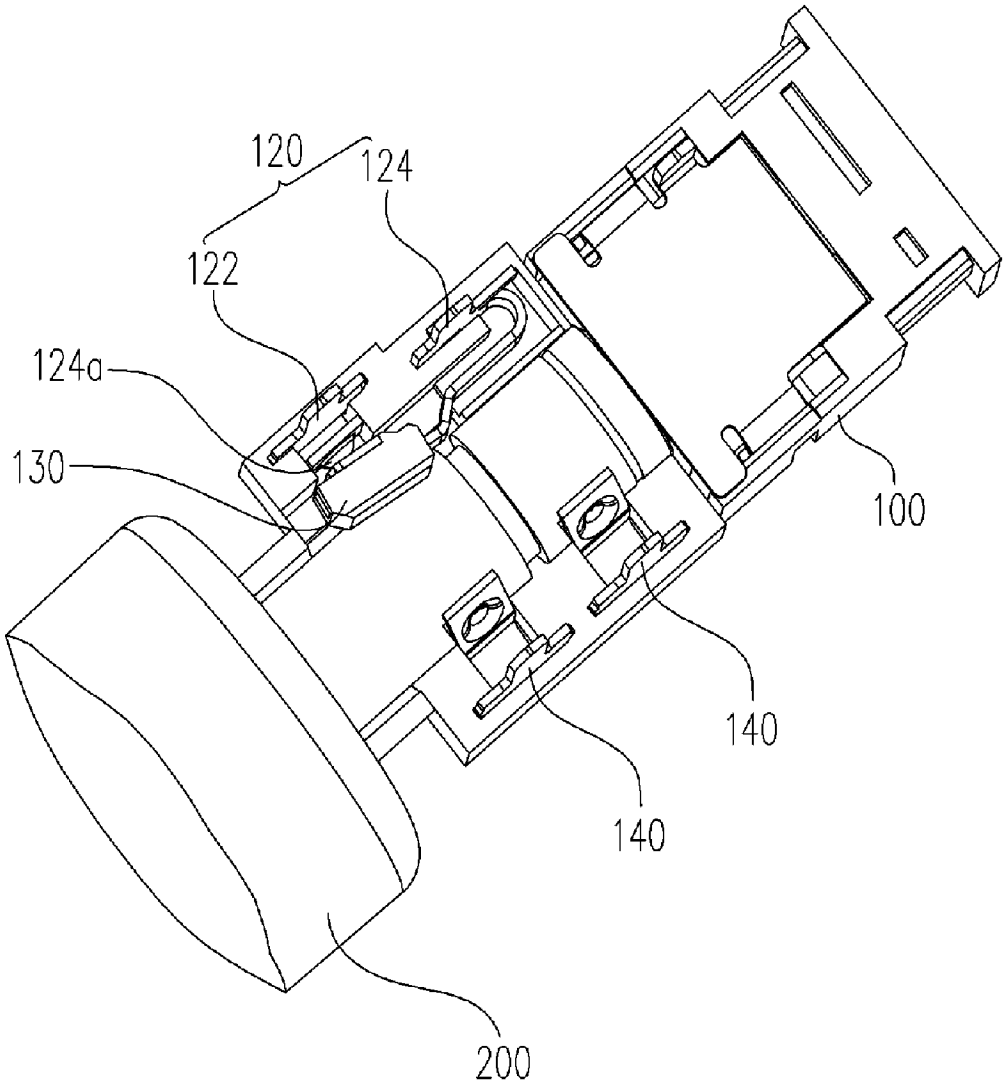
FIG. 3 is a perspective view of the audio jack connector shown in FIG. 1 after a plug is inserted.

FIG. 3 is a perspective view of the audio jack connector shown in FIG. 1 after a plug is inserted. For a better view of the connection between the plug and the internal terminals of the audio jack connector, a portion of the insulating housing in FIG. 3 is removed. As the plug 200 is being inserted into the chamber 114 (as shown in FIG. 2), the contacting part 124*a* of the second terminal 124 is pushed in such a way that the contacting part 124*a* not covered by the insulating wrap 130 is electrically connected to the first terminal 122. The electrical connection between the first terminal 122 and the second terminal 124 may trigger an internal system of the electronic product to initiate an audio message (or signal) transmission. In the meantime, the insulating wrap 130 covered portion of the contacting part 124*a* is electrically insulated from the plug 200. Hence, the second terminal 124 alone forms an electric circuit with the first terminal 122 and the plug 200 alone forms another electric circuit with the signal terminal 140. In other words, after inserting the plug 200 into the chamber 114 of the audio jack connector 100 in the present embodiment, the audio jack connector 100 creates two independent internal electric circuits. Therefore, the structure of the audio jack connector 100 in the present embodiment is able to meet the Azalia sound effect specification.

The foregoing description mainly describes the relative positions of various major components of the audio jack connector 100 and the connecting relationship between the major components after a plug 200 has been inserted into the audio jack connector 100. In the following, a more detailed description of the structure of these components is provided.

As shown in FIG. 2, the first terminal 122 in the present embodiment comprises, for example, a first terminal body 122*a* and a first elastic contact arm 122*b*. The first elastic contact arm 122*b* is, for example, an extension from the first terminal body 122*a* and has a first contact spot 122*b*'. The first contact spot 122*b*' is suitable for electrically connecting with the contacting part 124*a* not covered by the insulating wrap 130. On the other hand, the second terminal 124 comprises, for example, a second terminal body 124*b* and a second elastic contact arm 124*c*. The second elastic contact arm 124*c* is, for example, an extension from the second terminal body 124*b* to the moving path L and the contacting part 124*a* is located at one end of the second elastic contact arm 124*c* that extends to the moving path L.

In addition, each of the signal terminals 140 includes a signal terminal body 140*a* and a third elastic contact arm 140*b*. The third elastic contact arm 140*b* is, for example, an extension from the signal terminal body 140*a* and has a second contact spot 140*b*'. The second contact spot 140*b*' is suitable for electrically connecting with the plug 200 so that the electronic product can transmit audio messages (or signals). Moreover, the side edge of the first terminal 122, the second terminal 124 and each one of the signal terminals 140 has, for example, a plurality of latching structures (not shown). The first terminal 122, the second terminal 124 and each one of the signal terminals 140 may latch onto their respective inserting slots 116 respectively through these latching structures. In one preferred embodiment, the bottom surface of the insulating housing 110 in the audio jack connector 100 has one or more positioning pins 118 (as shown in FIG. 1). Through the positioning pins 118, the audio jack connector 100 is positioned accurately on an audio circuit board (not shown) inside the electronic product.

In the present embodiment, the audio jack connector 100 may further include a rear cover (not shown). The rear cover is disposed on another end of the corresponding insertion opening 112 of the insulating housing 110, for example. The purpose of setting up the rear cover is to isolate the insulating housing 110 from the interior of the electronic product and prevent dust particles from getting into the interior of the product through the insulating housing 110.

It should be noted that an insulating wrap covers a portion of the contacting part in the present invention in order to meet the Azalia sound effect specification. Therefore, when the plug is inserted into the audio jack connector, the portion of the contacting part not covered by the insulating wrap is electrically connected to the first terminal while the contacting part covered by the insulating wrap is electrically insulated from the plug. This design method produces an audio jack connector that meets the Azalia sound effect specification without requiring a significant change in the original design. In other words, the structural design in the present invention also takes into consideration the cost of producing the audio jack connector.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An audio jack connector suitable for connecting with a plug, comprising:

an insulating housing having an inserting hole and a chamber, wherein the inserting hole and the chamber are linked, and the plug is suitable for inserting through the inserting hole along a moving path and settling inside the chamber;

a set of switch terminals having a first terminal and a second terminal disposed on a corresponding sidewall of the chamber, wherein the second terminal has a contacting part located along the moving path;

an insulating wrap covering a portion of the contacting part; and a plurality of signal terminals disposed on the corresponding sidewall of the chamber;

wherein, when the plug is inserted into the chamber, the signal terminals and the portion of the contacting part covered by the insulating wrap are in contact with the plug, and as a result of the push by the plug, the portion of the contacting part of the second terminal not covered by the insulating wrap is electrically connected to the first terminal while the portion of the contacting part covered by the insulating wrap is electrically insulated from the plug.

2. The audio jack connector of claim 1, wherein the insulating housing further comprising a plurality of inserting slots disposed on a side edge of the chamber and linked with the chamber such that the set of switch terminals and signal terminals are disposed inside the respective inserting slots.

3. The audio jack connector of claim 1, wherein the insulating housing further comprising at least a positioning pin disposed on a bottom surface of the insulating housing.

4. The audio jack connector of claim 1, wherein the first terminal further comprising:

a first terminal body; and a first elastic contact arm extending from the first terminal body and having a first contact spot, wherein the first contact spot is suitable for electrically connecting with the portion of the contacting part not covered by the insulating wrap.

5. The audio jack connector of claim 1, wherein the second terminal further comprising:

a second terminal body, and a second elastic contact arm extending from the second terminal body to the moving path, wherein the contacting part is located at one end of the second elastic contact arm that extends to the moving path.

6. The audio jack connector of claim 1, wherein each of the signal terminals comprising:

a signal terminal body; and a third elastic contact arm extending from the signal terminal body and having a second contact spot, wherein the second contact spot is suitable for electrically connecting with the plug.

7. The audio jack connector of claim 1, further comprising a rear cover disposed on another end of the corresponding inserting hole of the insulating housing.

* * * * *